US009643434B2

(12) United States Patent
Segawa

(10) Patent No.: US 9,643,434 B2
(45) Date of Patent: May 9, 2017

(54) RECORDING APPARATUS

(71) Applicant: SEIKO EPSON CORPORATION, Tokyo (JP)

(72) Inventor: Yuichi Segawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/814,301

(22) Filed: Jul. 30, 2015

(65) Prior Publication Data

US 2016/0031234 A1 Feb. 4, 2016

(30) Foreign Application Priority Data

Jul. 31, 2014 (JP) ..... 2014-155870

(51) Int. Cl.

| | |
|---|---|
| ***B41J 2/175*** | (2006.01) |
| ***B41J 13/00*** | (2006.01) |
| ***B41J 11/00*** | (2006.01) |
| ***B41J 3/60*** | (2006.01) |
| ***B41J 29/02*** | (2006.01) |
| ***B41J 29/13*** | (2006.01) |

(Continued)

(52) U.S. Cl.

CPC ..... *B41J 13/0045* (2013.01); *B41J 2/1752* (2013.01); *B41J 2/17503* (2013.01); *B41J 3/60* (2013.01); *B41J 11/007* (2013.01); *B41J 29/023* (2013.01); *B41J 29/13* (2013.01); *B65H 29/125* (2013.01); *B65H 29/14* (2013.01); *B65H 29/247* (2013.01); *B65H 31/02* (2013.01); *B65H 85/00* (2013.01); *B65H 2301/4212* (2013.01); *B65H 2301/51214* (2013.01); *B65H 2402/10* (2013.01); *B65H 2405/115* (2013.01); *B65H 2405/1111* (2013.01); *B65H 2405/1117* (2013.01); *B65H 2405/11151* (2013.01); *B65H 2511/20* (2013.01)

(58) Field of Classification Search

CPC ... B41J 2/1752; B41J 2/17503; B41J 13/0045
See application file for complete search history.

(56) References Cited

U.S. PATENT DOCUMENTS

2012/0194582 A1* 8/2012 Matsubara ..... B41J 2/17566 347/7

FOREIGN PATENT DOCUMENTS

| | | |
|---|---|---|
| JP | 06-115064 | 4/1994 |
| JP | 06-115214 | 4/1994 |
| JP | 2012-035438 | 2/2012 |

* cited by examiner

*Primary Examiner* — Kristal Feggins
*Assistant Examiner* — Kendrick Lu
(74) *Attorney, Agent, or Firm* — Workman Nydegger

(57) ABSTRACT

A recording apparatus includes a recording portion; a liquid reservoir portion; a medium ejection route that is provided, at an end portion thereof, with a medium outlet from which the medium is ejected; an ejection roller that ejects the medium from the medium outlet; and a stacking member that stacks the medium. The medium ejection route includes, in an interval where the medium having been subjected to recording by the recording portion is transported to the medium outlet, a reversing curved route along which the medium is curved in a state where a recorded face of the medium faces an inner side of the curve, and the liquid reservoir portion is disposed, in a vertical direction, at a further antigravity direction side position than a position of the medium ejection route and a position of a movement trajectory drawn by the medium during a period until its stack on the stacking member.

12 Claims, 5 Drawing Sheets

(51) Int. Cl.

| | |
|---|---|
| ***B65H 29/12*** | (2006.01) |
| ***B65H 29/14*** | (2006.01) |
| ***B65H 29/24*** | (2006.01) |
| ***B65H 31/02*** | (2006.01) |
| ***B65H 85/00*** | (2006.01) |

RECORDING APPARATUS

BACKGROUND

1. Technical Field

The present invention relates to a recording apparatus including a recording portion for performing recording onto a medium.

2. Related Art

Heretofore, an ink jet printer has been well known as a kind of recording apparatus. This inkjet printer performs printing (recording) of images and the like onto paper, which is an example of various kinds of media, by ejecting inks serving as liquids (recording liquids) from a recording portion provided therein onto the paper which is intermittently transported. In such a printer, in order to stably supply the recording portion with the inks to be ejected from the recording portion, a liquid reservoir portion for reserving the inks therein is provided.

Particularly, in a printer including a recording portion provided with a recording head (line head) capable of ejecting inks across a paper portion extending in a paper width direction intersecting with a paper transport direction, the inks are substantially simultaneously ejected across the paper portion extending in the paper width direction, thus causing the increase of a liquid ejection amount of the inks ejected from the recording head. Accordingly, an ink reservoir portion provided in such a printer is required to reserve a large amount of inks therein. In response to this requirement, a printer (recording apparatus) including a liquid reservoir portion provided with a plurality of ink cartridges (liquid reservoirs) capable of reserving a large amount of inks has been proposed (refer to, for example, JP-A-2012-35438).

In existing printers, nevertheless, such a liquid reservoir portion for reserving a large amount of inks is disposed at a position where the liquid reservoir portion does not block paper that is ejected from a medium outlet (paper outlet) in a substantially horizontal direction from being properly stacked on a stacking member. That is, the liquid reservoir portion is disposed at a position which exists on the extension of an ejection direction of the paper ejected from the medium outlet, and at which the liquid reservoir portion does not overlap the stacking member, on which the paper is stacked, in a vertical direction (upward/downward direction) and overlaps the stacking member in a plane direction. For this reason, the horizontal-direction size of an apparatus body of the printer increases, and the plane area of the apparatus body when viewed in a vertical direction intersecting with the horizontal direction increases; thereby causing a problem in that an installation space having a large area is required.

In addition, such a situation is substantially common to recording apparatuses each including a recording portion for performing recording by ejecting liquids onto a medium; a liquid reservoir portion for reserving the liquids to be supplied to the recording portion; a medium ejection route that is provided, at an end portion thereof, with a medium outlet from which the medium is ejected; and a stacking member for stacking thereon the medium ejected from the medium outlet.

SUMMARY

An advantage of some aspects of the invention is that a recording apparatus is provided, which enables suppression of the increase of the plane area of an apparatus body of the recording apparatus even when a liquid reservoir portion for reserving liquids to be supplied to a recording portion thereof is provided in the apparatus body thereof.

Hereinafter, a configuration of such a recording apparatus as well as advantageous effects brought about by the configuration will be described.

A recording apparatus according to an aspect of the invention includes a recording portion that performs recording by ejecting a liquid onto a medium; a liquid reservoir portion that reserves therein the liquid to be supplied to the recording portion; a medium ejection route along which the medium having been subjected to recording by the recording portion is transported, and which is provided, at an end portion of the medium ejection route itself, with a medium outlet from which the medium is ejected; an ejection roller that causes the medium to be transported along the medium ejection route and that ejects the medium from the medium outlet to an outside of the medium ejection route; and a stacking member that stacks the medium having been ejected from the medium outlet on a stacking face of the stacking member itself. Further, the medium ejection route includes, in an interval where the medium having been subjected to recording by the recording portion is transported to the medium outlet, a reversing curved route along which the medium is curved and reversed in a state where a recorded face of the medium faces an inner side of the curve, and the liquid reservoir portion is disposed, in a vertical direction, at a further antigravity direction side position than a position of the reversing curved route and a position of a movement trajectory drawn by the medium during a period from the ejection of the medium from the medium outlet until the stack of the medium on the stacking member.

According to this configuration, the liquid reservoir portion is disposed at the antigravity direction side of the reversing curved route such that the liquid reservoir portion overlaps the reversing curved route; or the liquid reservoir portion is disposed at the antigravity direction side (i.e., at the upper side) of a trajectory of the medium which is ejected from the medium outlet and is stacked on the stacking member, such that the liquid reservoir portion overlaps the trajectory of the medium. Thus, it is possible to suppress the increase of the plane area of the apparatus body of the recording apparatus even when the liquid reservoir portion is provided inside the apparatus body.

In the above recording apparatus, preferably, the liquid reservoir portion is disposed so as to cover at least a portion of the reversing curved route when viewed from an antigravity direction side in a vertical direction.

According to this configuration, a space is formed above the reversing curved route and this space can be utilized as a space in which the liquid reservoir portion is contained. Thus, it is possible to suppress the increase of the plane area of the apparatus body of the recording apparatus without reducing the volume of the liquid reservoir portion.

The above recording apparatus preferably further includes a plurality of ejection rollers that include the ejection roller and that are each provided at a corresponding one of positions on the medium ejection route, and an ejection roller that is among the plurality of ejection rollers and that is located at the most downstream side position among the positions on the medium ejection route in a transport direction into which the medium is transported is disposed at a position overlapping the liquid reservoir portion when viewed in a horizontal direction.

According to this configuration, the position of the whole of the liquid reservoir portion is suppressed from becoming higher than that of the medium ejection route. Thus, it is possible to suppress the increase of the plane area of the apparatus body of the recording apparatus, and further, suppress the increase of the size of the apparatus body in an upward/downward direction intersecting with a horizontal direction.

The above recording apparatus preferably further includes an air blowing portion that is located at a further downstream side position than a position of the medium outlet in an ejection direction into which the medium is ejected and that blows air in a direction in which the medium having been ejected from the medium outlet is pressed toward a side of the stacking face, and the air blowing portion is disposed at a position overlapping the liquid reservoir portion when viewed in a horizontal direction.

According to this configuration, the air blowing portion makes it possible for the medium having been ejected from the medium ejection route to be stably stacked on the stacking face. Further, even when the air blowing portion is provided inside the apparatus body of the recording apparatus, it is possible to suppress the increase of the plane area of the apparatus body, and further, suppress the increase of the size of the apparatus body in an upward/downward direction intersecting with a horizontal direction.

In the above recording apparatus, preferably, the liquid reservoir portion is configured to include a plurality of liquid reservoirs each reserving a corresponding one of a plurality of color liquids, and a liquid reservoir that is among the plurality of liquid reservoirs and that reserves a color liquid that is ejected more frequently than any other one of the plurality of color liquids is disposed at a position that is located at an opposite side of the stacking member and that is located farther from the stacking member than a position of any other one of the plurality of liquid reservoirs.

According to this configuration, a liquid reservoir that is among the plurality of liquid reservoirs and that reserves a color liquid that is ejected more frequently than any other one of the plurality of color liquids is located at an upper position of a portion extending downward toward the gravity direction side up to the lowest position in a region existing at the gravity direction side of the reversing curved route. Thus, the liquid reservation amount of the relevant liquid reservoir which reserves the color liquid which is ejected more frequently than any other one of the color liquids can be made larger than that of any other one of the liquid reservoirs which reserves one of the other ones of the color liquids.

In the above recording apparatus, preferably, the medium ejection route is configured such that a transport direction in which the medium is transported from the reversing curved route to the medium outlet becomes an oblique direction that extends toward the medium outlet while gradually ascending toward the antigravity direction side.

According to this configuration, a space is formed at the antigravity direction side (i.e., at the upper side) of the reversing curved route or a medium ejection trajectory of the medium which is ejected from the medium outlet and is stacked on the stacking member. Thus, it is possible to suppress the increase of the plane area of the apparatus body of the recording apparatus by disposing the liquid reservoir portion in the relevant space.

In the above recording apparatus, preferably, the stacking face is configured to become an inclined face that inclines such that, the further a distance of a position on the inclined face from the medium outlet increases, the further a height of the position on the inclined face increases toward the antigravity direction side, and the ejection direction into which the medium is ejected from the medium outlet inclines toward the antigravity direction side more largely than the stacking face of the stacking member.

According to this configuration, it is possible to stably stack the medium on the stacking face in a state where the edge portion of the medium aligns, and further, a space of a large size is formed at the antigravity direction side of the reversing curved route or at the antigravity direction side (i.e., at the upper side) of the medium ejection trajectory constituted by the movement trajectory drawn by the medium during a period from its ejection from the medium outlet until its stack on the stacking member. Thus, this disposition of the liquid reservoir portion in the relevant space makes it possible for the liquid reservoir portion to have a large liquid reservation amount, and further, makes it possible to suppress the increase of the plane area of the apparatus body of the recording apparatus.

In the above recording apparatus, preferably, the liquid reservoir portion is disposed at an outer side of the reversing curved route; the stacking member is disposed at an inner side of the reversing curved route; and the reversing curved route overlaps the stacking member when viewed from a lateral side in the ejection direction into which the medium is ejected by the ejection roller. This configuration contributes to downsizing of the recording apparatus in a horizontal direction.

In the above recording apparatus, preferably, an upstream side edge portion of the stacking member in the ejection direction into which the medium is ejected by the ejection roller overlaps the medium ejection route when viewed from a top side. This configuration contributes to downsizing of the recording apparatus in a horizontal direction.

In the above recording apparatus, preferably, the reversing curved route overlaps the stacking member when viewed from a lateral side in the ejection direction into which the medium is ejected by the ejection roller. This configuration contributes to downsizing of the recording apparatus in a height direction.

The above recording apparatus preferably further includes a switchback route that is different from the medium ejection route along which the medium having been subjected to recording by the recording portion is transported; and a both-side route along which the medium having been subjected to recording by the recording portion is transported to the recording portion again and which includes a reversing route along which the medium having been subjected to switchbacking using the switchback route is transported so that a recorded face of the medium having been subjected to recording by the recording portion is reversed. Further, the switchback route is formed so as to include a curved portion extending along the reversing curved route, and the upstream side edge portion of the stacking member in the ejection direction into which the medium is ejected by the ejection roller overlaps the switchback route when viewed from a top side. This configuration contributes to downsizing of the recording apparatus in a horizontal direction.

In the above recording apparatus, preferably, the curved portion of the switchback route overlaps the stacking member and the both-side route when viewed from a lateral side in the ejection direction into which the medium is ejected by the ejection roller. This configuration contributes to downsizing of the recording apparatus in a height direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer which is an embodiment of a recording apparatus according to the invention will be described with reference to the drawings. This ink jet printer includes a recording portion ejecting ink as an example of liquid and performs printing (recording) of images including characters, graphics, and the like onto a sheet of paper as an example of sheet-shaped media by ejecting ink onto the sheet of paper.

Figure 1:
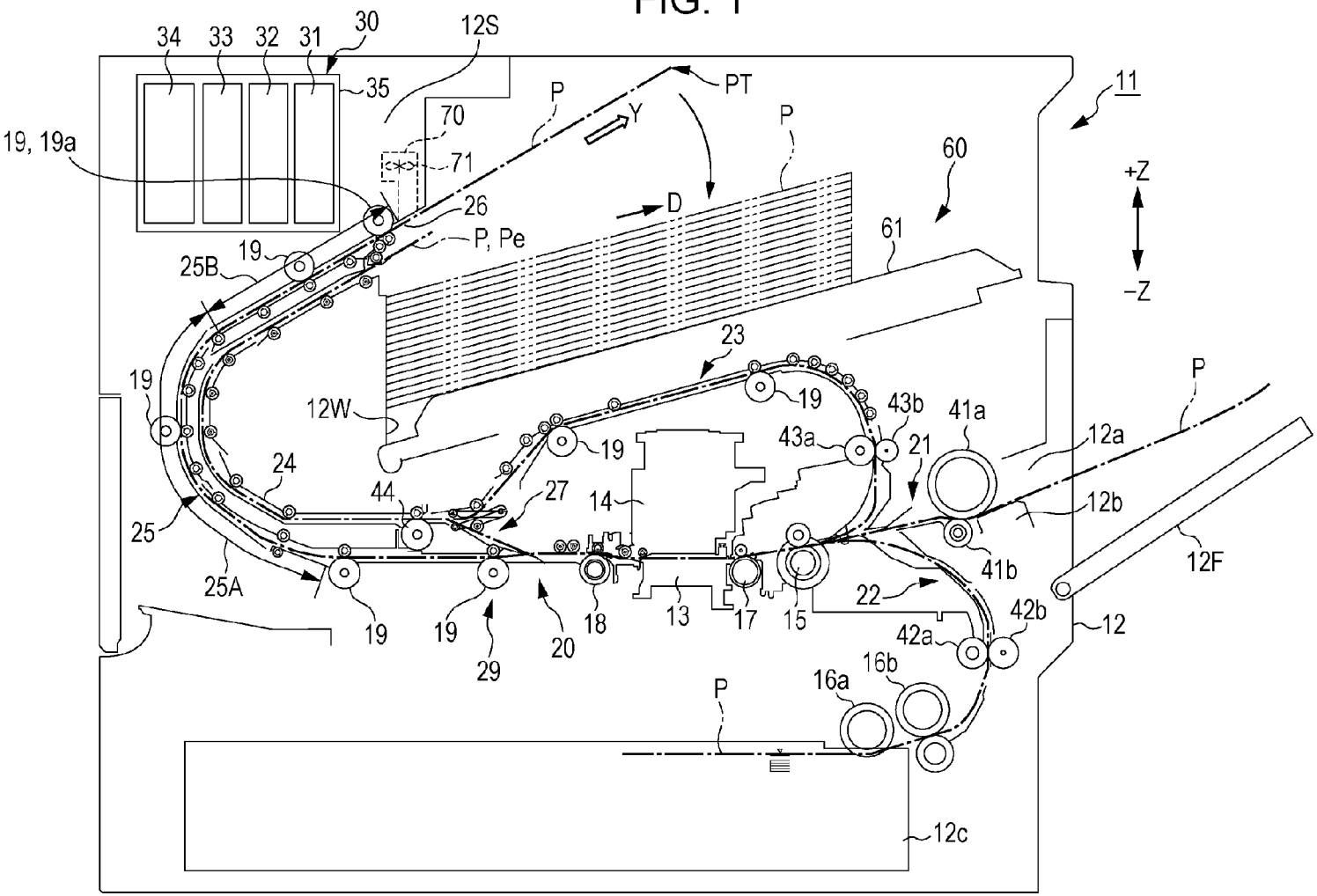
FIG. 1 is a schematic structural diagram of a printer according to an embodiment that is an example of embodiments of a recording apparatus according to the invention.

As shown in FIG. 1, a printer 11 according to an embodiment as an example of embodiments of an recording apparatus according to the invention includes, inside a housing 12 as an apparatus body thereof, a supporting table 13 for supporting a sheet of paper P from a gravity direction −Z side in a vertical direction; a recording portion 14 for performing printing of images onto the sheet of paper P; and a medium transport route 20 along which the sheet of paper P is transported. Further, the printer 11 includes a transport portion 29 that is constituted by a plurality of rollers (twin rollers) and that transports the sheet of paper P along the medium transport route 20.

In FIG. 1, a direction perpendicular to the surface of a drawing sheet of FIG. 1 corresponds to a width direction of the sheet of paper P (this width direction being denoted by a reference sign X in FIG. 2) and a direction intersecting with this width direction X corresponds to a transport direction, in which the printer 11 transports the sheet of paper P on the supporting table 13, and then transports it along the medium transport route 20. The recording portion 14 is provided, in a bottom portion thereof, with a line head serving as a liquid ejection head capable of simultaneously ejecting inks across substantially the entire width direction X intersecting with the transport direction of the sheet of paper P, and performs printing of images by causing the line head to, from an antigravity direction +Z side in a vertical direction, eject the inks onto the sheet of paper P which is intermittently transported on the supporting table 13 so that the ejected inks are adhered on the sheet of paper P.

The sheet of paper P having been subjected to printing is transported from the recording portion 14 to the medium transport route 20 by a twin paper ejection roller 18 and a plurality of other rollers, that is, twin transport rollers 19, and then is ejected to the outside of the medium transport route 20 from a medium outlet 26 that is provided at an edge portion of the medium transport route 20, in an ejection direction Y that gradually ascends toward the antigravity direction +Z side. The sheet of paper P having been ejected from the medium outlet 26 moves (drops) in a gravity direction −Z at the time when an upper edge PT of the sheet of paper P has reached a position having a predetermined height, and then is stacked in a stacked layer state represented by chain double-dashed lines in FIG. 1 on a stacking member 60 that is disposed so as to overlap an antigravity direction +Z side portion (an upper side portion) of the recording portion 14.

Figure 2:
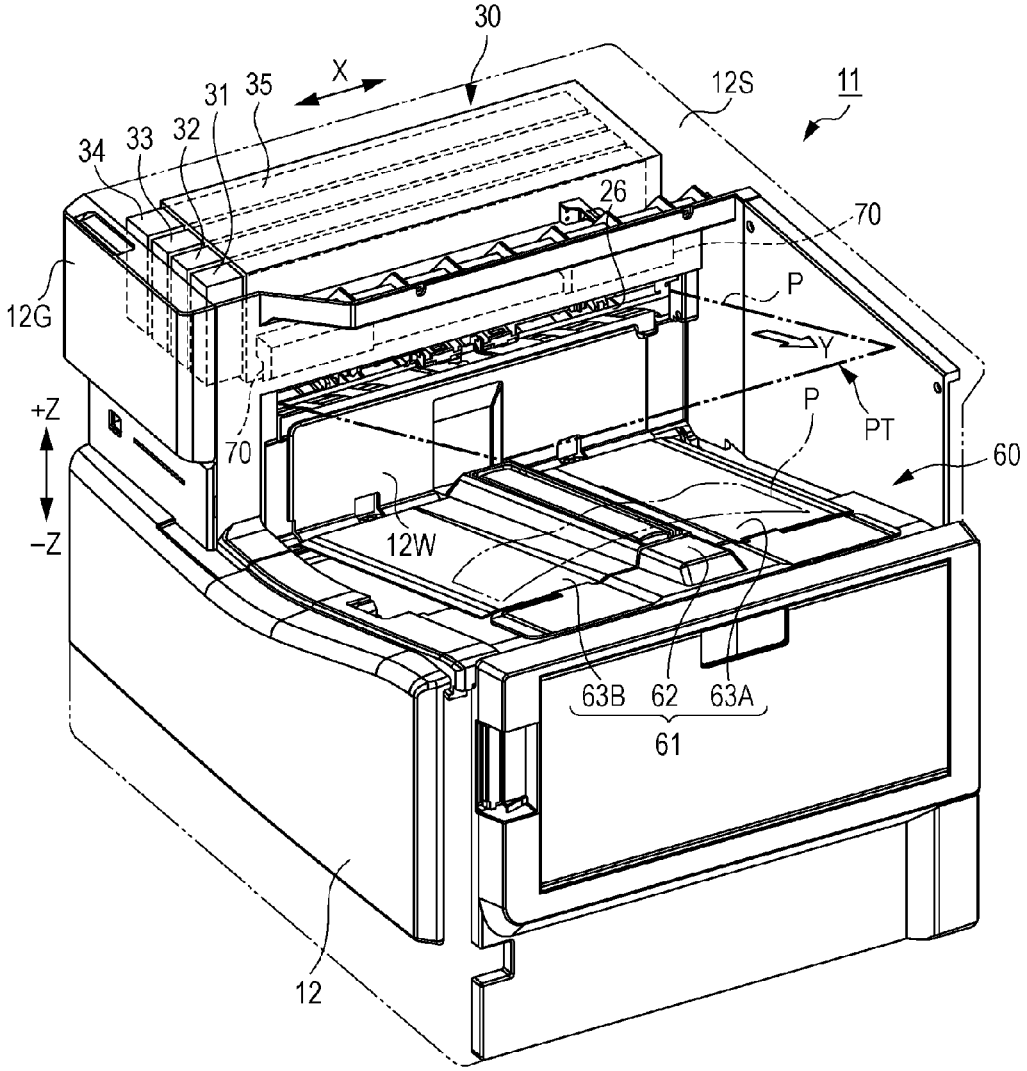
FIG. 2 is a structural perspective view of the printer according to the embodiment and being in a state in which its housing is partially removed.

As shown in FIGS. 1 and 2, the stacking member 60 includes a stacking face 61 extending in a gradually-ascending inclined direction D that inclines such that, the further a distance of a position on the stacking face 61 from the medium outlet 26 increases in the ejection direction Y into which the sheet of paper P is ejected, the further the height of the position on the stacking face 61 increases toward the antigravity direction +Z side, and the sheet of paper P is stacked on this stacking face 61. The stacking face 61 is formed of a convex portion 62 that is provided so as to correspond to substantially the center of the width (extending in the width direction X shown in FIG. 2) of the sheet of paper P and that extends in the ejection direction Y, and planes 63A and 63B that are each provided at a corresponding one of both sides of the convex portion 62 in the width direction X.

The sheet of paper P having been stacked on the stacking face 61 configured in such a way as described above moves along the inclined face of the stacking face 61 in a direction opposite the ejection direction Y, and a paper edge at the side opposite the ejection-direction Y side comes into contact with a vertical side wall 12W that is provided at the lower side of the medium outlet 26, and aligns along the vertical side wall 12W, as represented by the chain double-dashed line in FIG. 1. In addition, the ejection direction Y of the sheet of paper P is configured so as to incline toward the antigravity direction +Z side more largely than the inclined direction D of the stacking face 61.

In this embodiment, as shown in FIG. 1, the medium transport route 20 includes a medium ejection route 25 that transports the sheet of paper P from a portion below the recording portion 14 to the medium outlet 26, and a medium feeding route that feeds the sheet of paper P to the recording portion 14. The medium feeding route is constituted by a first medium feeding route 21, a second medium feeding route 22, and a third medium feeding route 23.

The medium ejection route 25 includes, in an interval where the sheet of paper P having been subjected to printing by the recording portion 14 is transported to the medium outlet 26, a curved route 25A that is curved such that a recorded face of the sheet of paper P having been subjected to printing by the recording portion 14 faces the inner side of the curve, and a straight route 25B along which the sheet of paper P is unidirectionally transported from the curved route 25A toward the medium outlet 26. Further, a plurality of twin transport rollers 19 are each provided at a corresponding one of a plurality of portions on the medium ejection route 25, and these twin transport rollers 19 function as ejection rollers for ejecting the sheet of paper P from the medium outlet 26. Further, a transport operation on the medium ejection route 25 reverses the sheet of paper P such that, during a transport operation on the curved route 25A and the straight route 25B, the sheet of paper P is brought into a state in which a recorded face of the sheet of paper P faces the gravity direction −Z side from a state in which the recorded face thereof faces the antigravity direction +Z side. That is, the curved route 25A and the straight route 25B function as a reversing curved route. Thus, the sheet of paper P is brought into a state in which a recorded face thereof faces the stacking face 61 by passing through the medium ejection route 25 including the reversing curved route, and then is ejected from the medium outlet 26 onto the stacking member 60 located above the recording portion 14.

Further, in the medium ejection route 25 included in the medium transport route 20, a transport direction into which the sheet of paper P is transported along the straight route 25B is a unidirectional direction into which the straight route 25B extends, and in this embodiment, this unidirectional direction is configured to be an oblique direction that gradually ascends toward the antigravity direction +Z side. Thus, a direction (unidirectional direction) in which the straight route 25B obliquely extends becomes the ejection direction Y into which the sheet of paper P is ejected from the medium outlet 26. Further, after the sheet of paper P, which has passed through the medium ejection route 25 functioning as the reversing curved route, has been ejected from the medium outlet 26 in the ejection direction Y, the sheet of paper P draws a movement trajectory during a period from its movement (drop) in the gravity direction −Z due to its weight until its stack on the stacking member 60, and this movement trajectory becomes an ejection trajectory of the sheet of paper P, that is, the medium ejection trajectory.

In the first medium feeding route 21, the sheet of paper P inserted from an insertion inlet 12*a* that is exposed to the outside when a cover 12F provided on a side face of the housing 12 is in an open state is transported toward the recording medium 14. That is, the sheet of paper P having been inserted from the insertion inlet 12*a* is pressed against a first driving roller 41*a* by a hopper 12*b* and is transported by rotation driving of the first driving roller 41*a*. The transported sheet of paper P is pinched between the first driving roller 41*a* and a first driven roller 41*b* and then is transported toward the recording portion 14.

In the second feeding route 22, one of sheets of paper P stacked in a paper cassette 12*c* that is insertably/extractably provided in a bottom portion located at the gravity direction −Z side of the housing 12 is transported toward the recording portion 14. That is, uppermost sheets of paper P among sheets of paper P that are stacked in the paper cassette 12*c* in a stacked layer state are fed out by a pickup roller 16*a*, and then are separated by a twin separation roller 16*b* so that the fed-out sheets of paper p can be fed one by one. Further, a single sheet of paper P having been separated thereby is pinched between a second driving roller 42*a* and a second driven roller 42*b*, and then is transported toward the recording portion 14 by rotation driving of the second driving roller 42*a*.

In the third medium feeding route 23, when both-side printing on both sheet faces (paper faces) of a sheet of paper P is performed, the third medium feeding route 23 functions as a both-side route along which the sheet of paper P having been subjected to printing on one of the both sheet faces thereof is transported to the recording portion 14 again to be subjected to printing on the other one of the both side sheets thereof by the recording portion 14. That is, a branch transport route 24 that is branched from the medium ejection path 25 in accordance with an operation of a branch mechanism 27 that is provided midway on the medium ejection route 25 is provided at a further downstream side position than that of the recording portion 14 in the transport direction into which the sheet of paper P is transported. This branch transport route 24 is provided with a twin branch transport roller 44, which is rotatable both in a normal rotation direction and in a reverse rotation direction, at the downstream side of the branch mechanism 27, an includes a curved portion that curves along the reversing curved route 25.

When both-side printing is performed, the sheet of paper P having been subjected to printing on one of the both sheet faces thereof is fed into the branch transport route 24 once from the recording portion 14 side toward the stacking member 60 side by the twin branch transport route roller 44 in a state of rotating in the normal rotation direction. At this time, the occurrence of a situation where a portion Pe of the transport-direction side edge of the sheet of paper P having been fed into the branch transport route 24 protrudes from the medium outlet 26 is considered, and thus, the position of such protrusion is set such that the portion Pe does not come into contact with any one of the sheets of paper P having been stacked on the stacking member 60 in a stacked layer state.

Subsequently, the sheet of paper P having been fed into the branch transport route 24 is transported along the branch transport route 24 in an opposite direction, that is, from the stacking member 60 side toward the recording portion 14 side, by the twin branch transport route roller 44 in a state of rotating in the reverse rotation direction. That is, the branch transport route 24 functions as a switchback route. At this time, the sheet of paper P transported in the opposite direction is fed into the third medium feeding route 23, and then is transported toward the recording portion 14 by some ones of the plurality of twin transport rollers 19. Through this feeding into the third medium feeding route 23, the sheet of paper P is reversed such that a sheet face thereof having not yet been subjected to printing faces the recording portion 14, and then, the reversed sheet of paper P is pinched between a third driving roller 43*a* and a third driven roller 43*b*. The sheet of paper P having been pinched between the third driving roller 43*a* and the third driven roller 43*b* is transported toward the recording portion 14 by rotation driving of the third driving roller 43*a*. That is, the third medium feeding route 23 includes a revering route.

The sheet of paper P having been transported on the individual medium feeding routes toward the recording portion 14 is transported to a twin alignment roller 15 that is disposed at the upstream side of the recording portion 14 in the transport direction, and there, the tip of the sheet of paper P comes into contact with the twin alignment roller 15 being in a rotation-halted state. Further, a skew of the sheet of paper P relative to its transport direction is corrected depending on a condition where the sheet of paper P has come into contact with the twin alignment roller 15 being in a rotation-halted state (that is, a skew correction is made). Further, the sheet of paper P having been subjected to the skew correction is transported toward the recording portion 14 side in an alignment state by subsequent rotation driving of the twin alignment roller 15.

The sheet of paper P having been transported to the recording portion 14 side by the twin alignment roller 15 is transported while facing the recording portion 14 by a twin paper feeding roller 17 that is disposed at the upstream side of the recording portion 14 in the transport direction of the sheet of paper P, as well as the twin paper ejection roller 18 and the twin transport rollers 19, these twin rollers being disposed at the downstream side of the recording portion 14 in the transport direction of the sheet of paper P. The sheet of paper P being transported while facing the recording portion 14 is subjected to ejection of inks from the recording portion 14 and thereby is subjected to printing.

As shown in FIGS. 1 and 2, the printer 11 is provided, inside the housing 12 thereof, with a liquid reservoir portion 30 for reserving inks to be supplied to the recording head 14. That is, the liquid reservoir portion 30 supplies the reserved inks to the recording portion 14 via ink supplying routes (not illustrated) constituted by tubes or the like, and the recording portion 14 performs printing of images and the like by ejecting the inks having been supplied from the liquid reservoir portion 30 onto the sheet of paper P.

In this embodiment, the liquid reservoir portion 30 has a substantially cuboid shape, and is disposed at a further antigravity direction +Z side position than the position of the ejection trajectory of the sheet of paper P (the medium ejection trajectory) in a vertical direction. Further, the liquid reservoir portion 30 is disposed so as to overlap at least a portion of the medium ejection route 25 when viewed from the antigravity direction +Z side in a vertical direction.

That is, the antigravity direction +Z side portion (i.e., the upper side portion) of the medium ejection route 25 forming a reversing curved route is the straight route 25B to which the curved rout 25A continuously extends and which has an oblique shape extending in a unidirectional direction. Thus, in the inside of the housing 12, a space 12S having a substantially triangular shape (a substantially right triangular shape) when viewed in the width direction X is formed at the antigravity direction +Z side (the upper side) of a portion between an antigravity direction +Z side portion of the curved rout 25A and the medium outlet 26 of the straight route 25B forming the oblique shape.

In this embodiment, this space 12S is formed inside the housing 12 so as to, in the width direction X, cover the medium ejection route 25 when viewed from an upper side. Further, in the inside of the space 12S, the liquid reservoir portion 30 is disposed so as to cover at least a portion of the medium ejection route 25 when viewed from the upper side. In addition, in this embodiment, the liquid reservoir portion 30 is disposed so as to, in the width direction X, cover the entire medium ejection route 25 when viewed from the upper side.

Further, in the space 12S, a twin transport roller 19*a* that is among the plurality of twin transport rollers 19 provided on the medium ejection route 25 and that is located at the most downstream side position on the medium ejection route 25 in the transport direction into which the sheet of paper P is transported functions as a twin ejection roller, and is provided at a position overlapping the liquid reservoir portion 30 when viewed in a horizontal direction.

Moreover, an air blowing portion 70 that is located at a further downstream side position than the position of the medium outlet 26 in the ejection direction into which the sheet of paper P is ejected, and that blows air in a direction in which the sheet of paper P ejected from the medium outlet 26 is pressed toward the stacking face 61 side, is provided in a space except for a space occupied by the liquid reservoir portion 30 in the space 12S. This air blowing portion 70 is configured to include a rotation fan 71 and is provided at a position overlapping the liquid reservoir portion 30 when viewed in a horizontal direction. In addition, in this embodiment, in the air blowing portion 70, a pair of air blowing openings is disposed in the width direction of the sheet of paper P so as to allow each of the air blowing openings thereof to face a corresponding one of both width-direction X edge portions of the sheet of paper P centering around the convex portion 62 of the stacking plate 61 (refer to FIG. 2). Naturally, the air blowing portion 70 may be constituted by a single air blowing opening having a shape in which its opening is consecutively formed in the width direction X of the sheet of paper P.

The liquid reservoir portion 30 is configured to include ink cartridges 31, 32, 33, and 34 each serving as a liquid reservoir for reserving a corresponding one of a plurality of kinds of inks (four kinds of inks, in this embodiment), and a frame body 35 including the cartridges 31, 32, 33, and 34 attached thereto. Each of the ink cartridges 31, 32, 33, and 34 has a substantially cuboid shape having a long side, and the frame body has a box shape having faces one of which is an opening. Further, each of the ink cartridges 31, 32, 33, and 34 is attached to the frame body 35 so as to be capable of being inserted/extracted into/from the frame body 35 in its long-side direction as an insertion/extraction direction via the opening.

In this embodiment, the insertion/extraction direction of each of the ink cartridges 31, 32, 33, and 34 is a direction along the width direction X. Thus, in the housing 12, an opening portion (not illustrated) through which the opening of the frame body 35 is exposed to the outside when viewed in the width direction X is formed, and a reservoir portion cover 12G capable of bringing the opening portion into an uncovered/covered state is provided. Further, it is possible for, for example, a user of the printer 11 to expose the opening portion to the outside by opening the reservoir portion cover 12G and, via the exposed opening portion, insert/extract each of the ink cartridges 31, 32, 33, and 34 into/from the frame body 35 via the opening in the insertion/extraction direction along the width direction X.

Further, in this embodiment, for each of the ink cartridges 31, 32, 33, and 34 that are in a state of being attached to the frame body 35, its short side extends in a vertical direction; its long side extends in the width direction X; and its thickness side extends in a horizontal direction parallel to the ejection direction Y. Further, the shot side lengths (the vertical direction lengths) of the ink cartridges 31, 32, 33, and 34 are the same, and the ink cartridges 31, 32, 33, and 34 are attached to the frame body 35 in a state where their respective thickness sides align.

Further, in this embodiment, the ink cartridge 34 among the ink cartridges 31, 32, 33, and 34 is an ink cartridge that reserves an ink more frequently ejected from the recording portion 14 than any one of inks reserved in the ink cartridges 31, 32, and 33. The ink cartridge 34 is disposed at a position that is located at the opposite side of the medium outlet 26 from the stacking member 60 and that is farther from the medium outlet 26 than a position of any one of the ink cartridges 31, 32, and 33. Further, the thickness of the ink cartridge 34 is made larger than that of the ink cartridges 31, 32, and 33, and thus, the ink cartridge 34 is capable of reserving an ink up to an amount larger than a maximum amount of an ink reserved in any one of the ink cartridges 31, 32, and 33.

The printer 11 having such a configuration as described above brings about the following operations.

That is, the printer 11 is configured such that the liquid reservoir portion 30 is disposed at a further antigravity direction +Z side position than the position of the ejection trajectory of the sheet of paper P having been subjected to printing by the recording portion 14, or the position of the medium ejection route 25, in a vertical direction, thus, enabling suppression of the increase of the horizontal-direction length of the housing 12 along the ejection direction Y due to the disposition of the liquid reservoir portion 30 without any influence on the ejection of the sheet of paper P onto the stacking member 60.

Further, the printer 11 is configured such that the ejection direction Y into which the sheet of paper P is ejected from the medium outlet 26 inclines toward the antigravity direction +Z side more largely than the inclination direction D of the stacking face 61, and thus, when the sheet of paper P is stacked onto the stacking face 61, air interposed between a recorded face of the sheet of paper P and the stacking face 61 is pushed out toward the ejection direction Y side. As a result, this pushed-out air causes a reaction force that moves the sheet of paper in a direction opposite the ejection direction Y, and this reaction force brings the sheet of paper P into contact with the vertical side wall 12W, thereby enabling the sheet of paper P to be stacked on the stacking face 61 in a state where the edge portion of the sheet of paper P aligns.

Moreover, the printer 11 is configured such that, on the medium ejection route 25, the twin transport roller 19*a*, which is located at the most downstream side in the transport direction of the sheet of paper P, is provided at a position overlapping the liquid reservoir portion 30 when viewed in a horizontal direction, thus enabling suppressing the entire liquid reservoir portion 30 from being located at a position higher than that of the medium ejection route 25. Further, in the air blowing portion 70, each of the pair of the air blowing openings 70 that are provided so as to interpose a space therebetween in the width direction X blows air from an upper side toward the sheet of paper P in a state of being ejected from the medium outlet 26, and thus, the air blown by each of the air blowing openings comes into contact with the sheet of paper P, thereby causing a corresponding one of the both width-direction X edge portions of the sheet of paper P to be pressed down centering around the convex portion 62 of the stacking face 61.

Here, the supplementary description of the internal layout of the printer 11 will be made below. In the printer 11, preferably, the liquid reservoir portion 30 is disposed at the opposite side of the straight route 25B, which is part of the reversing curved route 25, from the stacking member 60, in other words, the liquid reservoir portion 30 is disposed at an outer side of the reversing curved route 25 and the stacking member 60 is disposed at an inner side of the reversing curved route 25, and the reversing curved route 25 overlaps the stacking member 60 when viewed from a lateral side in a direction into which the sheet of paper P is ejected by the twin ejection roller 19*a*. This configuration contributes to downsizing of the printer 11 in a horizontal direction.

Moreover, preferably, the upstream side edge portion of the stacking member 60 in the direction into which the sheet of paper P is ejected by the twin ejection roller 19*a* overlaps the reversing curved route 25 when viewed from a top side. This configuration contributes to downsizing of the printer 11 in a horizontal direction.

Further, preferably, the reversing curved route 25 overlaps the stacking member 60 when viewed from a lateral side in the ejection direction into which of the sheet of paper P is ejected by the twin ejection roller 19*a*. This configuration contributes to downsizing of the printer 11 in a height direction.

Additionally, the upstream side edge portion of the stacking member 60 in the direction into which the sheet of paper P is ejected by the twin ejection roller 19*a* overlaps the switchback route 24 when viewed from a top side. This configuration contributes to downsizing of the printer 11 in a horizontal direction.

Moreover, preferably, the curved portion of the switchback route 24 overlaps the stacking member 60 and the both-side route when viewed from a lateral side in the ejection direction into which the sheet of paper P is ejected from the twin ejection roller 19*a*. This configuration contributes to downsizing of the printer 11 in a horizontal direction.

According to the aforementioned embodiment, the following advantageous effects can be brought about.

(1) The printer 11 is configured such that the liquid reservoir portion 30 is disposed at the antigravity direction +Z side of the medium ejection route 25 forming a reversing curved route, so as to overlap the medium ejection route 25, or the liquid reservoir portion 30 is disposed at the antigravity direction +Z side (i.e., at the upper side) of the trajectory of the sheet of paper P that is ejected from the medium outlet 26 and is stacked on the stacking member 60 so as to overlap the trajectory of the sheet of paper P. Thus, it is possible to suppress the increase of the plane area of the housing 12 even when the liquid reservoir 30 is provided inside the housing 12.

(2) The printer 11 is configured to be capable of disposing the liquid reservoir portion 30 in the space 12S which is formed above the medium ejection route 25. Thus, it is possible to suppress the increase of the plane area of the housing 12 without reducing the volume of the liquid reservoir portion 30.

(3) The printer 11 is configured to suppress the entire liquid reservoir portion 30 from being located at a position higher than that of the medium ejection route 25. Thus, it is possible to not only suppress the increase of the plane area of the housing 12, but also suppress the increase of the size of the housing 12 in an upward/downward direction intersecting with a horizontal direction.

(4) It is possible to stably stack the sheet of paper P ejected from the medium ejection route 25 onto the stacking face 61 by using the air blowing portion 70, and further, it is possible to, even when the air blowing portion 70 is provided inside the housing 12, not only suppress the increase of the plane area of the housing 12, but also suppress the increase of the size of the housing 12 in an upward/downward direction intersecting with a horizontal direction.

(5) The medium ejection route 25 is configured to form an oblique direction in which the sheet of paper P is transported toward the medium outlet 26 while gradually ascending toward the antigravity direction +Z side. Thus, the space 12S is formed at the antigravity direction +Z side (i.e., the upper side) of the medium ejection route 25 and the movement trajectory of the sheet of paper P that is ejected from the medium outlet 26 and is stacked on the stacking member 60, that is, the ejection trajectory of the sheet of paper P. Accordingly, it is possible to suppress the increase of the plane area of the housing 12 by disposing the liquid reservoir portion 30 in the space 12S. Further, since the ejection trajectory of the sheet of paper P is oblique, the height of the upper edge PT of the sheet of paper P, that is located at the highest position in the ejection trajectory, is increased to a further antigravity direction +Z side position, that is, a higher position, than the position of the medium outlet 26 in a vertical direction. Thus, when the height of the top edge portion of the housing 12 is increased in accordance with the increased height of the upper edge PT of the sheet of paper P, as a result, the space 12S which is formed inside the housing 12 having been subjected to the increase of the height of the top edge portion thereof is largely broadened. As a result, it is possible to increase the volume of the liquid reservoir portion 30 simultaneously with suppressing the increase of the plane area of the housing 12 by disposing the liquid reservoir portion 30 in the broadened space 12S.

(6) The stacking face 61 is configured to form an inclined face that inclines such that, the further a distance of a position on the inclined face from the medium outlet 26 increases, the further the height of the position on the inclined face increases toward the antigravity direction +Z side. Further, the ejection direction Y into which the sheet of paper P is ejected from the medium outlet 26 is configured so as to incline toward the antigravity direction +Z side more largely than the inclined direction D of the stacking face 61 of the stacking member 60. Accordingly, it is possible to stably stack the sheet of paper P on the stacking face 61 in a state where the edge portion of the sheet of paper P aligns. Further, the space 12S of a large size is formed at the antigravity direction +Z side (i.e., at the upper side) of the ejection trajectory of the sheet of paper P, which is constituted by the movement trajectory drawn by the sheet of paper P during a period from its ejection from the medium outlet 26 until its stack on the stacking member 60. Accordingly, it is possible to increase reservation amount of each of the inks reserved in the liquid reservoir portion 30 and suppress the increase of the plane area of the housing 12 by disposing the liquid reservoir portion 30 in the space 12S of such a large size.

In addition, the aforementioned embodiment may be modified into different embodiments described below.

In the printer 11 according to the aforementioned embodiment, the short side lengths (the vertical-direction lengths) of the ink cartridges 31, 32, 33, and 34 may not be the same with one another.

That is, the ink cartridge 34 that reserves an ink that is most frequently ejected from the recording portion 14 is disposed at a position that is located at the opposite side of the medium outlet 26 from the stacking member 60 and that is farthest from the medium outlet 26, and further, the ink cartridge 34 is located at an upper position of a portion extending downward toward the gravity direction −Z side up to the lowest position in a region existing above the medium ejection route 25. Thus, in the space 12S, a space portion which extends in a vertical direction and in which the ink cartridge 34 can be disposed becomes broader than any one of space portions which extend in a vertical direction and in each of which a corresponding one of the ink cartridges 31, 32, and 33 is disposed.

Figure 3:
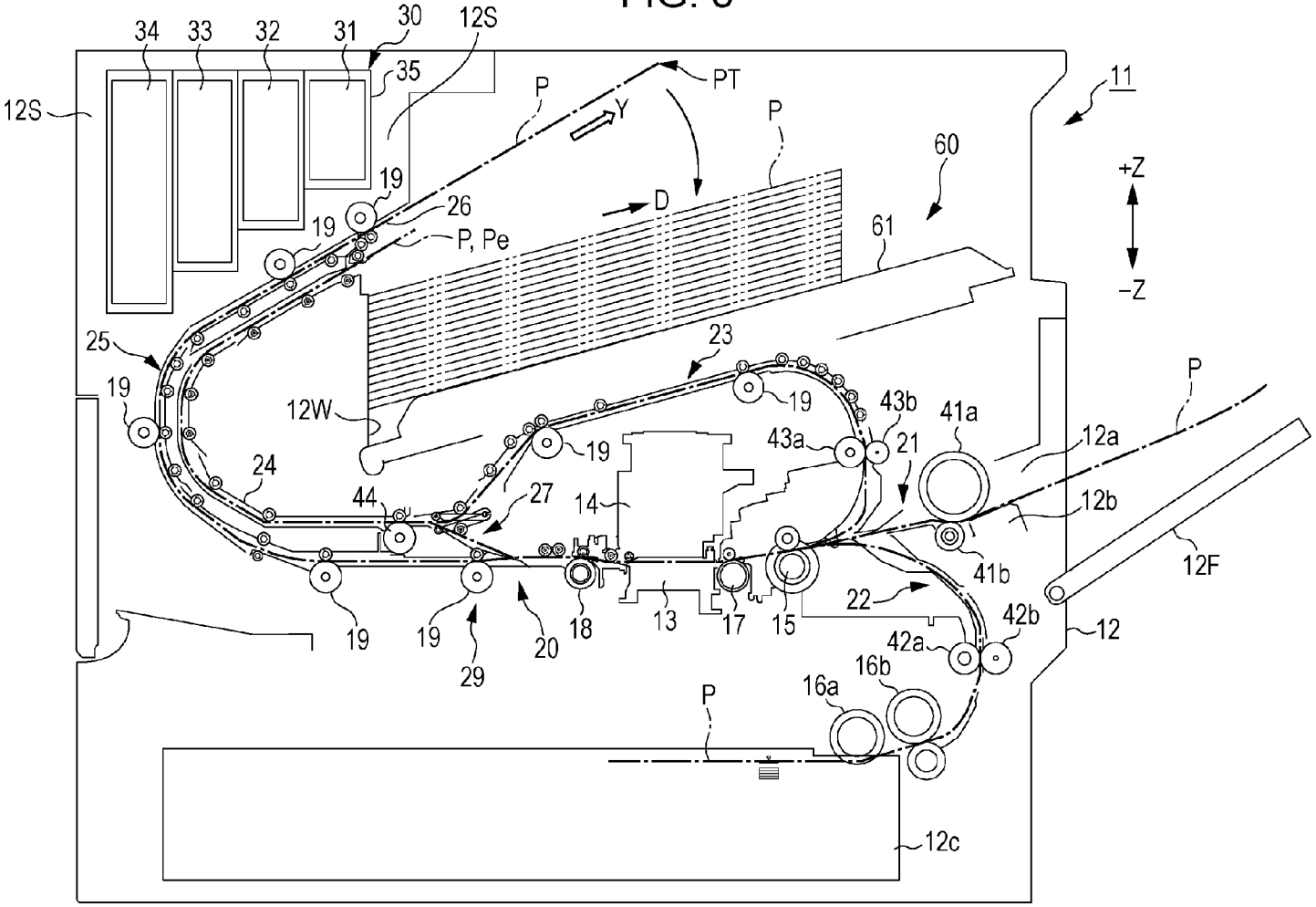
FIG. 3 is a schematic structural diagram of the printer according to the embodiment and being in a state in which a liquid reservoir portion as a modification example of an original liquid reservoir portion is provided.

Here, in this modification example, as shown in FIG. 3, in the printer 11 according to the aforementioned embodiment, the short side length (i.e., the vertical direction length) of each of the ink cartridges 31, 32, 33, and 34 that are attached to the liquid reservoir portion 30 (the frame body 35) is changed such that, the further a distance of a target ink cartridge from the medium outlet 26 increases in a direction opposite a direction toward the stacking member 60, the further the short side length of the target ink cartridge increases. That is, it is possible to, in the space 12S formed at the upper side of the medium ejection route 25 extending in an oblique direction, allow the ink cartridge 34, which is located farther from the medium outlet 26 than any one of the ink cartridges 31, 32, and 33 in a direction opposite a direction toward the stacking member 60, to have a short side length (a vertical-direction length) longer than that of any one of the ink cartridges 31, 32, and 33. In addition, in the case of the liquid reservoir portion 30 shown in FIG. 3, the ink reservation amount of each of the ink cartridges 31, 32, 33, and 34 becomes larger in this order.

Accordingly, it is possible to allow the ink cartridge 34, which reserves an ink which is more frequently ejected than any other inks reserved in the ink cartridges 31, 32, and 33, to reserve more ink than any other ink cartridges 31, 32, and 33 by making the short side length of the ink cartridge 34 larger than that of the ink cartridges 31, 32, and 33 without making the thickness of the ink cartridge 34 larger than that of the ink cartridges 31, 32, and 33. The short side length of the ink cartridge 34 may be made longer than that of the ink cartridges 31, 32, and 33 with the thickness of the ink cartridge 34 being larger than that of the ink cartridges 31, 32, and 33.

According to this modification example, the following advantageous effect can be brought about in addition to the above advantageous effects (1) to (6).

(7) The ink cartridge 34, which reserves an ink which is more frequently ejected than any one of inks reserved in the ink cartridges 31, 32, and 33, is located in a broadened space existing at an upper position of a portion extending downward toward the gravity direction −Z side up to the lowest position in a region existing at the gravity direction +Z side of the medium ejection route 25. Thus, it is possible to make the ink reservation amount of the ink cartridge 34 larger than that of any one of the ink cartridges 31, 32, and 33.

In the aforementioned embodiment, the ejection direction Y into which the sheet of paper P is ejected from the medium election outlet 26 may not be the direction that inclines toward the antigravity direction +Z side more largely than the inclined direction D of the stacking face 61 of the stacking member 60. For example, the ejection direction Y into which the sheet of paper P is ejected from the medium election outlet 26 may be a direction parallel to the inclined direction D of the stacking face 61 of the stacking member 60. In this respect, a modification example will be described below with reference to FIG. 4.

Figure 4:
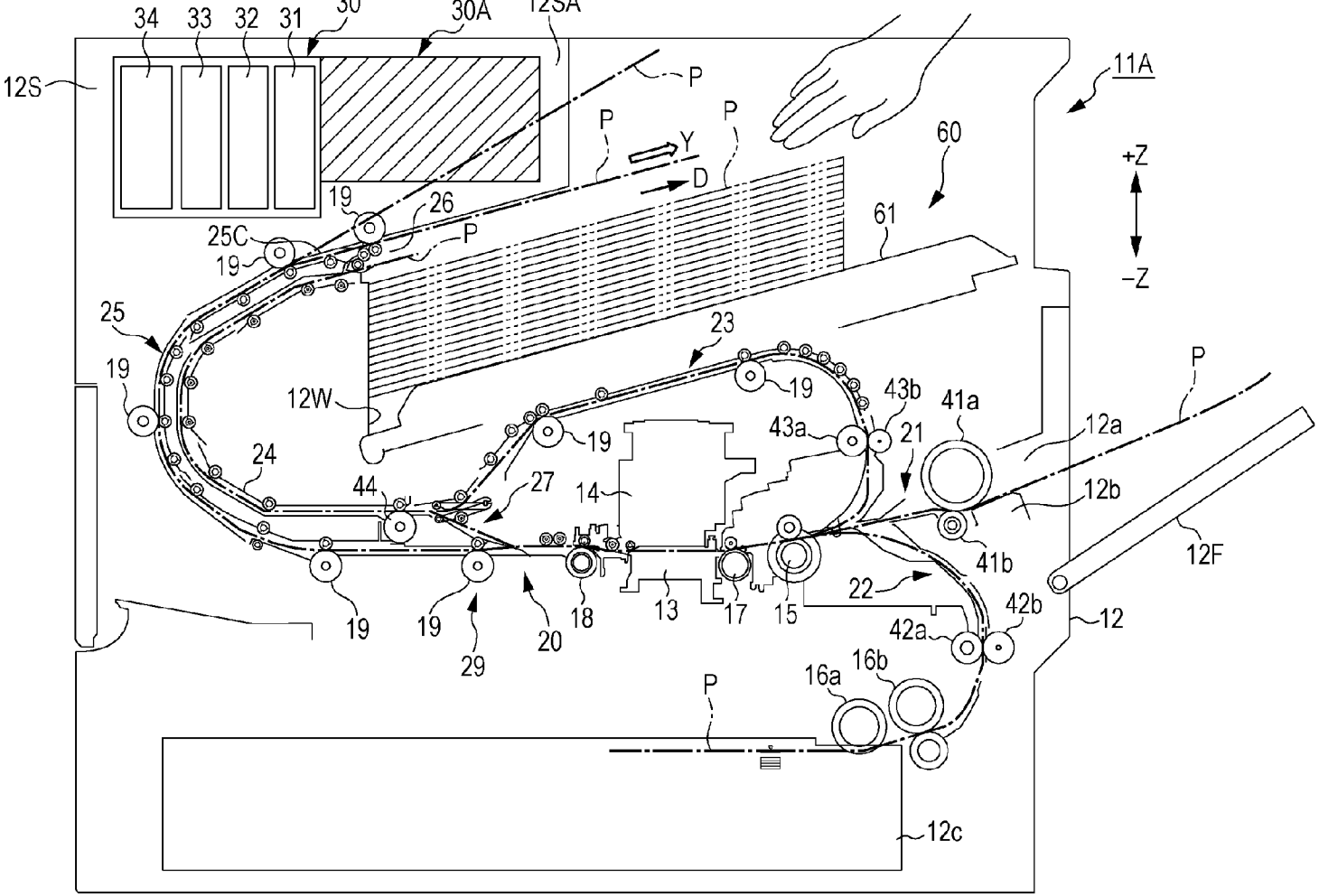
FIG. 4 is a schematic structural diagram of a printer that is a modification example of the printer according to the embodiment.

As shown in FIG. 4, a printer 11A in this modification example is configured such that a transport route 25C provided at a position immediately before the position of the medium outlet 26 on the medium ejection route 25 forming a reversing curved route inclines toward the antigravity direction +Z side more gently than the straight route 25B of the medium ejection route 25 in the printer 11 according to the aforementioned embodiment. That is, the printer 11A is configured such that an ejection direction (represented by a thick dot-and-dash line in FIG. 4) into which the sheet of paper P is ejected from the medium outlet 26 forms a direction parallel to the inclined direction D of the stacking face 61, and inclines toward the antigravity direction +Z side more downward than the ejection direction (represented by a thin dot-and-dash line in FIG. 4) into which the sheet of paper P is ejected from the medium outlet 26 in the printer 11 according to the aforementioned embodiment.

As a result of the above configuration of the printer 11A in which the ejection direction Y of the sheet of paper P is made inclined more downward than that of the printer 11 according to the aforementioned embodiment, an extended space 12SA is formed at a position located at a further antigravity direction +Z side position than that of the ejection trajectory of the sheet of paper P in a vertical direction and located at a side of the ejection direction Y of the sheet of paper P relative to the space 12S existing inside the housing 12.

In the extended space 12SA having been formed at the position described above, as represented by a hatched area in FIG. 4, another liquid reservoir portion 30A can be provided in addition to the liquid reservoir portion 30. Naturally, the liquid reservoir portion 30 may be provided integrally with the liquid reservoir portion 30A. In addition, in this case, the liquid reservoir portion 30A extends up to a position overlapping part of the stacking member 60 (the stacking face 61) when viewed from the antigravity direction +Z side in a vertical direction, and the liquid reservoir portion 30 and the liquid reservoir portion 30A, which may be integrally provided, are disposed so as to cover the entire medium ejection route 25 when viewed from the antigravity direction +Z side in a vertical direction.

In addition, it is possible to, in the inside of the housing 12, extend the extended space 12SA toward the ejection direction Y side up to a position that makes it possible to, in a portion above the stacking face 61 of the stacking member 60, ensure an opening whose size is enough for a user to pick up the sheet of paper P having been stacked on the stacking member 60 through a means of inserting the user's hand, or the like.

According to the configuration of the printer 11A in this modification example, the sheet of paper P can be stably stacked on the stacking face 61 in a state where its edge portion aligns along the vertical side wall 61, and further, the space 12S and the extended space 12SA, which form a large space, are formed at the antigravity direction +Z side of the medium ejection route 25 or at the antigravity direction +Z side (i.e., the upper side) of the trajectory of the sheet of paper P ejected from the medium outlet 26. Thus, through a method of disposing the liquid reservoir portion 30 and the liquid reservoir portion 30A in the space 12S and the extended space 12SA, respectively, it is possible to increase the ink reservation amount by reserving inks in both of the liquid reservoir portion 30 and the liquid reservoir portion 30A, and further, suppress the increase of the plane area of the housing 12 when viewed in a vertical direction.

In the aforementioned embodiment, the medium ejection route 25 may not be necessarily configured such that the transport direction of the sheet of paper P to be transported toward the medium outlet 26 is the oblique direction extending toward the medium outlet 26 and gradually ascending toward the antigravity direction +Z side. In this respect, a modification example will be described below with reference to FIG. 5.

Figure 5:
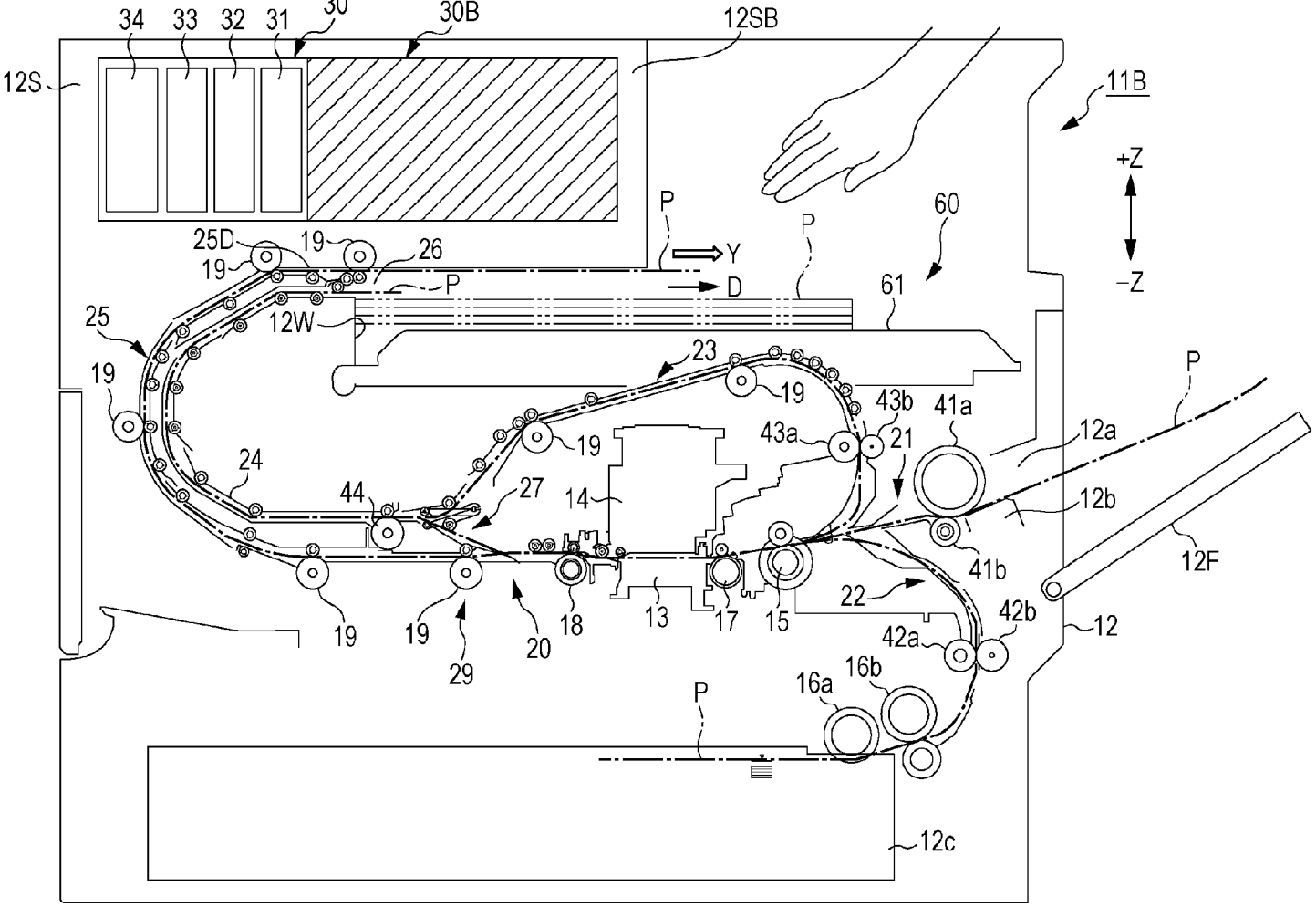
FIG. 5 is a schematic structural diagram of a printer that is another modification example of the printer according to the embodiment.

As shown in FIG. 5, a printer 11B in this modification example is configured such that the stacking face 61 of the stacking member 60 forms a horizontal face extending in a direction parallel to the ejection direction Y of the sheet of paper P, and a transport route 25D located at a position immediately before the position of the medium outlet 26 on the medium ejection route 25 forms a transport route that extends in a substantially horizontal direction that inclines at an angle of approximately zero degrees relative to a horizontal direction. Thus, the printer 11B is configured such that the ejection direction (represented by a thick dot-and-dash line in FIG. 5) into which the sheet of paper P is ejected from the medium outlet 26 forms a direction parallel to the stacking face 61 whose inclined direction D extends in a horizontal direction.

As a result, in the printer 11B, the ejection direction Y of the sheet of paper P is configured to form a horizontal direction, thereby enabling formation of an extended space 12SB resulting from extending the space 12S, which is contained inside the housing 12 and is located at a further antigravity direction side position than the position of the ejection trajectory of the sheet of paper P in a vertical direction, in the ejection direction Y of the sheet of paper P such that the vertical-direction size (area) of the space 12S is maintained as it is.

In the extended space 12SB having been formed in this, as represented by a hatched area in FIG. 5, another liquid reservoir portion 30B can be provided in addition to the liquid reservoir portion 30. Naturally, the liquid reservoir portion 30 may be provided integrally with the liquid reservoir portion 30B. In addition, the liquid reservoir portion 30B extends up to a position overlapping part of the stacking member 60 (the stacking face 61) when viewed from the antigravity direction +Z side in a vertical direction, and the liquid reservoir portion 30 and the liquid reservoir portion 30B, which may be integrally provided, are disposed so as to cover the entire medium ejection route 25 when viewed from the antigravity direction +Z side in a vertical direction.

Further, it is possible to, in the inside of the housing 12, extend the extended space 12SB in the ejection direction Y up to a position that makes it possible to, in a portion above the stacking face 61 of the stacking member 60, ensure an opening whose size is enough for a user to pick up the sheet of paper P having been stacked on the stacking member 60 through a means of inserting the user's hand, or the like.

According to the configuration of the printer 11B in this modification example, the space 12S and the extended space 12SB are formed at the antigravity direction side +Z side (the upper side) of the medium ejection route 25 forming a reversing curved route, and the ejection trajectory of the sheet of paper P, which is constituted by the movement trajectory drawn by the sheet of paper P during a period from its ejection from the medium outlet 26 and until its stack on the stacking member 60. Through a method of disposing the liquid reservoir portion 30 and the liquid reservoir portion 30B in the space 12S and the extended space 12SB, respectively, it is possible to increase the ink reservation amount by reserving inks in both of the liquid reservoir portion 30 and the liquid reservoir portion 30B, and further, suppress the increase of the plane area of the housing 12 when viewed in a vertical direction.

In the printer 11 according to the aforementioned embodiment, the ink cartridge 34, which reserves an ink which is most frequently ejected from the recording portion 14, may not be necessarily disposed at a position that is located at the opposite side of medium outlet 26 from the stacking member 60 and that is farthest from the medium outlet 26. For example, although omitted from illustration here, the ink cartridge 34, which reserves an ink which is most frequently ejected from the recording portion 14, may be disposed, in the liquid reservoir portion 30 (the frame body 35), at a position closest to the stacking member 60 which is located at the ejection direction Y side of the medium outlet 26.

Further, in the printer 11A in the above modification example (refer to FIG. 4), the ink cartridge 34, which reserves an ink which is most frequently ejected from the recording portion 14, may not be necessarily disposed at a position that is located at the opposite side of the medium outlet 26 from the stacking member 60 and that is farthest from the medium outlet 26. For example, in the case where the extended space 12SA is a broad space, the ink cartridge 34, which reserves an ink which is most frequently ejected from the recording portion 14, may be attached to the liquid reservoir portion 30A provided in the extended space 12SA, and the other ink cartridges 31, 32, and 33 may be attached to the liquid reservoir portion 30.

Alternatively, in the printer 11B in the above modification example (refer to FIG. 5), the ink cartridge 34, which reserves an ink which is most frequently ejected from the recording portion 14, may not be necessarily disposed at a position that is located at the opposite side of the medium outlet 26 from the stacking member 60 and that is farthest from the medium outlet 26. For example, in the case where the extended space 12SB is a broad space, the ink cartridge 34, which reserves an ink which is most frequently ejected from the recording portion 14, may be attached to the liquid reservoir portion 30B provided in the extended space 12SB, and the other ink cartridges 31, 32, and 33 may be attached to the liquid reservoir portion 30.

In the aforementioned embodiment, the liquid reservoir portion 30 may not be necessarily disposed so as to cover at least a portion of the medium ejection route 25 forming a reversing curved route, when viewed from the antigravity direction +Z side in a vertical direction. For example, the liquid reservoir portion 30 may be disposed in a portion that constitutes the liquid reservoir portion 30A of the printer 11A in the above modification example, or the liquid reservoir portion 30B of the printer 11B in the above modification example, and that does not cover the medium ejection route 25 forming a reversing curved route when viewed from the antigravity direction +Z side in a vertical direction.

In the aforementioned embodiment, the space 12S which is formed at the upper side of the medium ejection route 25 may not be necessarily disposed so as to cover the whole of the medium ejection route 25 in the width direction X when viewed from the antigravity direction +Z side in a vertical direction. That is, the space 12S may be formed such that at least a portion of the space 12S overlaps the medium ejection route 25. In this case, the liquid reservoir portion 30 provided inside the space 12S is disposed so as to cover at least a portion of the medium ejection route 25 when viewed from the antigravity direction +Z side in a vertical direction.

In the aforementioned embodiment, the configuration of the recording portion 14 is not limited to the configuration employing a so-called line head that includes a liquid ejection head capable of ejecting inks across substantially the entire width direction X of the sheet of paper P. For example, the recording portion 14 may be constituted by a so-called serial head including a liquid ejection head for ejecting inks, on which a carriage that reciprocates in a direction intersecting with the transport direction of the sheet of paper P is mounted.

In the aforementioned embodiment, the printer 11 as a recording apparatus may be a fluid ejecting apparatus that performs recording by ejecting or discharging fluids other than inks (the fluids including liquids; liquid substances each resulting from dispersing or mixing particles of function materials in a liquid; fluid substances such as gels; and solids capable of being flown and ejected as fluids). For example, the printer 11 may be a liquid substance ejecting apparatus that performs printing by ejecting liquid substances each containing, in the form of dispersion or dissolution, materials such as electrode materials or color materials (pixel materials) for use in, for example, manufacturing of a liquid crystal display, an electroluminescence (EL) display, and a field emission display. Further, the printer 11 may be a fluid substance ejecting apparatus that ejects fluid substances such as gels (for example, physical gels), or an ejecting apparatus (for example, a toner jet printer) that ejects solids, for example, powdery substances (powder particle substances) such as toner. Further, the invention can be applied to any one of these kinds of fluid ejecting apparatuses. In addition, in this patent description, the "fluid substance" is a concept that does not include any fluid substance composed of only one or more gas substances, and the "fluid substance" includes, for example, a liquid (including an inorganic solvent, an organic solvent, a liquid solution, a liquid resin, a liquid metallic material (a metallic melt), and the like); a liquid substance; a fluid substance; and a powder particle substance (including a particle substance and a powdery substance).

The entire disclosure of Japanese Patent Application No.: 2014-155870, filed Jul. 31, 2014 is expressly incorporated by reference herein.

What is claimed is:

1. A recording apparatus comprising:

a recording portion that performs recording by ejecting a liquid onto a medium;

a liquid reservoir portion that reserves therein the liquid to be supplied to the recording portion;

a medium ejection route along which the medium having been subjected to recording by the recording portion is transported, and which is provided, at an end portion of the medium ejection route itself, with a medium outlet from which the medium is ejected;

an ejection roller that causes the medium to be transported along the medium ejection route and that ejects the medium from the medium outlet to an outside of the medium ejection route; and a stacking member that stacks the medium having been ejected from the medium outlet on a stacking face of the stacking member itself, wherein the medium ejection route includes, in an interval where the medium having been subjected to recording by the recording portion is transported to the medium outlet, a reversing curved route along which the medium is curved and reversed in a state where a recorded face of the medium faces an inner side of the curve, and wherein the liquid reservoir portion is disposed at a further antigravity direction side position than a position of the reversing curved route so as to cover at least a portion of the reversing curved route when viewed from an antigravity direction side in a vertical direction.

2. The recording apparatus according to claim 1, wherein the liquid reservoir portion is disposed at an outer side of the reversing curved route, and the stacking member is disposed at an inner side of the reversing curved route, and wherein the reversing curved route overlaps the stacking member when viewed from a lateral side in an ejection direction into which the medium is ejected by the ejection roller.

3. The recording apparatus according to claim 2, wherein an upstream side edge portion of the stacking member in the ejection direction into which the medium is ejected by the ejection roller overlaps the medium ejection route when viewed from a top side.

4. The recording apparatus according to claim 3, wherein the reversing curved route overlaps the stacking member when viewed from a lateral side in the ejection direction into which the medium is ejected by the ejection roller.

5. The recording apparatus according to claim 3, wherein the stacking face is configured to become an inclined face that inclines such that, the further a distance of a position on the inclined face from the medium outlet increases, the further a height of the position on the inclined face increases toward the antigravity direction side, and wherein the ejection direction into which the medium is ejected from the medium outlet inclines toward the antigravity direction side more largely than the stacking face of the stacking member.

6. The recording apparatus according to claim 2, further comprising:

a switchback route that is different from the medium ejection route along which the medium having been subjected to recording by the recording portion is transported; and a both-side route along which the medium having been subjected to recording by the recording portion is transported to the recording portion again and which includes a reversing route along which the medium having been subjected to switchbacking using the switchback route is transported so that a recorded face of the medium having been subjected to recording by the recording portion is reversed, wherein the switchback route is formed so as to include a curved portion extending along the reversing curved route, and wherein the upstream side edge portion of the stacking member in the ejection direction into which the medium is ejected by the ejection roller overlaps the switchback route when viewed from a top side.

7. The recording apparatus according to claim 6, wherein the curved portion of the switchback route overlaps the stacking member and the both-side route when viewed from a lateral side in the ejection direction into which the medium is ejected by the ejection roller.

8. The recording apparatus according to claim 1, further comprising a plurality of ejection rollers that include the ejection roller and that are each provided at a corresponding one of positions on the medium ejection route, and wherein an ejection roller that is among the plurality of ejection rollers and that is located at the most downstream side position among the positions on the medium ejection route in a transport direction into which the medium is transported is disposed at a position overlapping the liquid reservoir portion when viewed in a horizontal direction.

9. The recording apparatus according to claim 1, further comprising an air blowing portion that is located at a further downstream side position than a position of the medium outlet in the ejection direction into which the medium is ejected and that blows air in a direction in which the medium having been ejected from the medium outlet is pressed toward a side of the stacking face, wherein the air blowing portion is disposed at a position overlapping the liquid reservoir portion when viewed in a horizontal direction.

10. The recording apparatus according to claim 1, wherein the liquid reservoir portion is configured to include a plurality of liquid reservoirs each reserving a corresponding one of a plurality of color liquids, and wherein a liquid reservoir that is among the plurality of liquid reservoirs and that reserves a color liquid that is ejected more frequently than any other one of the plurality of color liquids is disposed at a position that is located at an opposite side of the stacking member and that is located farther from the stacking member than a position of any other one of the plurality of liquid reservoirs.

11. The recording apparatus according to claim 1, wherein the medium ejection route is configured such that a transport direction in which the medium is transported from the reversing curved route to the medium outlet becomes an oblique direction that extends toward the medium outlet while gradually ascending toward the antigravity direction side.

12. The recording apparatus according to claim 1, wherein at least a portion of the liquid reservoir portion is disposed so as to cover at least a portion of the stacking member when viewed from the antigravity direction side in a vertical direction.

* * * * *